United States Patent [19]

Rinkewich

[11] Patent Number: 4,566,633

[45] Date of Patent: Jan. 28, 1986

[54] LONG RANGE SPRINKLER WITH CONTROLLED APPLICATION RATE

[76] Inventor: Isaac Rinkewich, 12 Fishman Maimon St., Tel-Aviv, Israel

[21] Appl. No.: 594,727

[22] Filed: Mar. 29, 1984

[30] Foreign Application Priority Data

Aug. 4, 1983 [IL] Israel ..... 69428

[51] Int. Cl.[4] ..... B05B 3/04

[52] U.S. Cl. ..... 239/237

[58] Field of Search ..... 239/237, 240, 263, 239, 239/242, 100, 99, 97, DIG. 1, 380, 381; 137/624.14; 251/122

[56] References Cited

U.S. PATENT DOCUMENTS

| | | | |
|---|---|---|---|
| Re. 20,826 | 8/1938 | Kind et al. | 239/99 |
| 3,820,714 | 6/1974 | Erickson et al. | 239/240 |
| 3,924,809 | 12/1975 | Troup | 239/DIG. 1 |
| 4,277,029 | 7/1981 | Rabitsch | 239/DIG. 1 |

*Primary Examiner*—Jeffrey V. Nase
*Assistant Examiner*—Scott D. Malpede
*Attorney, Agent, or Firm*—Benjamin J. Barish

[57] ABSTRACT

A long range sprinkler with controlled application rate comprises a plunger which is cyclically reciprocated by a drive to restrict and enlarge the nozzle throat, such as to enable a larger size nozzle to be used for obtaining a larger range, while the discharge rate is restricted by cyclically reciprocating the plunger to restrict the nozzle.

19 Claims, 16 Drawing Figures

LONG RANGE SPRINKLER WITH CONTROLLED APPLICATION RATE

BACKGROUND OF THE INVENTION

The present invention relates to water sprinklers such as are widely used for irrigation purposes. The invention is particularly applicable with respect to long-range rotary sprinklers, and is therefore described below with respect to this application.

A large number of different types of rotary water sprinklers have been developed and are now in use. As a rule, particularly with respect to long-range sprinklers (i.e., having a range of about 50 m. and more), it is usually desirable to increase the range and area coverage for any particular sprinkler size and water line pressure, since the greater the range of the sprinkler, the fewer the sprinklers required for irrigating any particular area.

SUMMARY OF THE INVENTION

An object of the present invention is to provide a new water sprinkler, and particularly one having an increased range with controlled application rate.

According to a broad aspect of the present invention, there is provided a water sprinkler comprising: a housing having an inlet connectable to a pressurized water supply line, and a nozzle through which the water issues in the form of a jet; a control member cyclically movable between a first limit position wherein the nozzle is open but its area is enlarged to thereby increase the range and rate of water flow therethrough, and a second limit position wherein the nozzle is still open but its area is restricted to thereby decrease the range and rage of water flow therethrough; and a drive driven by the energy of the water in the pressurized water supply line for cyclically driving the control member to restrict and enlarge the nozzle size.

According to more specific aspects of the invention, the nozzle includes a throat, and said control member is in the form of a plunger cyclically reciprocated by the drive to restrict and enlarge the nozzle throat; also, the nozzle is carried by a sprinkler head rotatably mounted to the housing, the drive also cyclically displacing the sprinkler head about the vertical axis of the sprinkler.

It will thus be seen that the novel sprinkler is based on the known principle that sprinkler range is directly proportional to nozzle size, the larger the nozzle size the longer the range for the same water pressure. However, the novel sprinkler enables a larger size nozzle to be used for obtaining a large range, but restricts the discharge rate by driving the control member, i.e. the recipricatory plunger, to cyclically restrict and enlarge the nozzle discharge area.

A number of embodiments of the invention are described below, for purposes of example, showing different arrangements for cyclically driving the plunger and also for cyclically rotating the sprinkler head. In all the described examples, the cycles of rotation of the sprinkler head are much larger than the cycles of reciprocation of the plunger. For example, the plunger may reciprocate 20–40 complete cycles per minute, whereas the sprinkler head may rotate one rotation in about six–ten minutes. Also, in these described embodiments, the restricted area of the nozzle is never less than 20% of the enlarged area of the nozzle in these embodiments.

Further features and advantages of the invention will be apparent from the description below.

The invention is herein described, by way of example only, with reference to the accompanying drawings, wherein:

DESCRIPTION OF PREFERRED EMBODIMENTS

Figures 1, 1A, 1B:
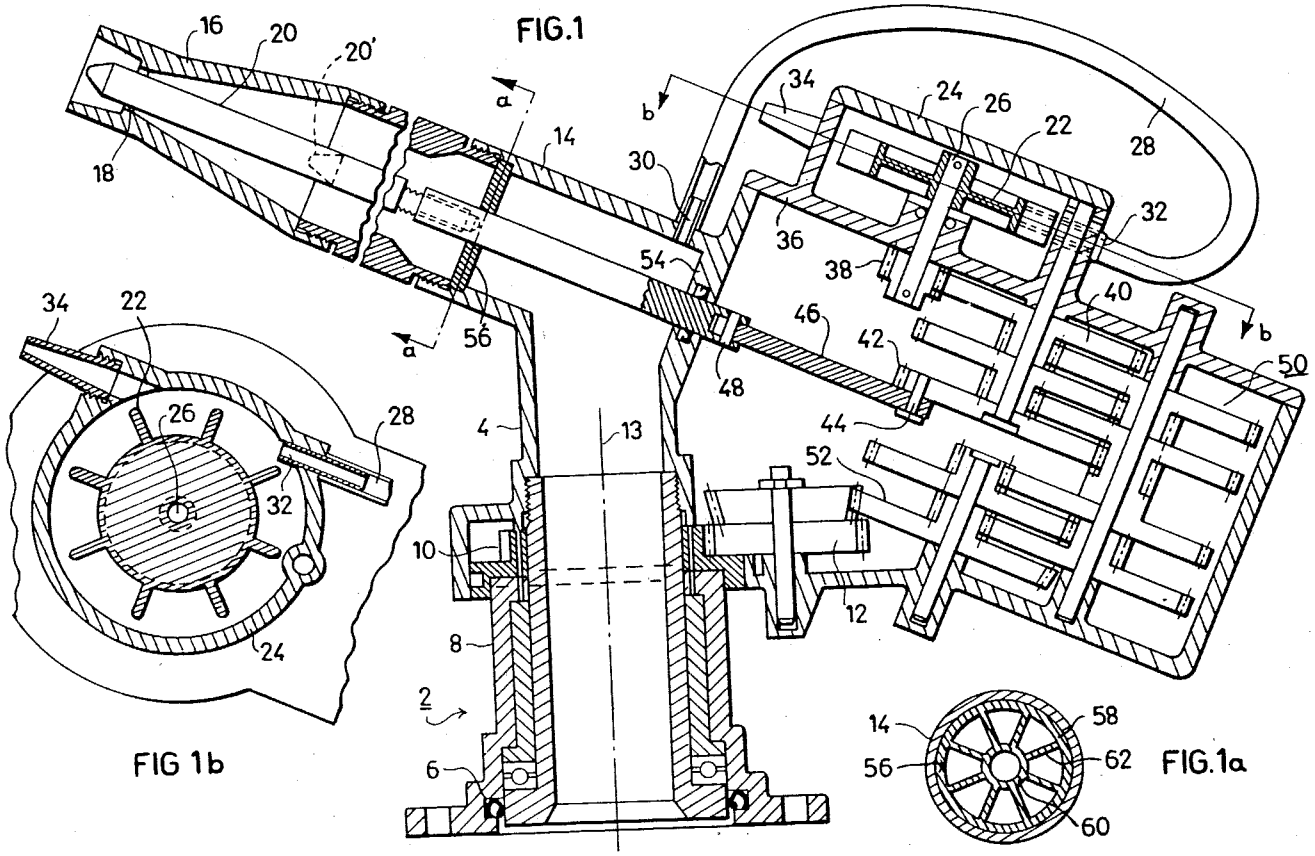
FIG. 1 is a longitudinal sectional view illustrating one form of long-range rotary sprinkler constructed in accordance with the present invention, FIGS. 1*a* and 1*b* being sections along lines a—a and b—b, respectively; of FIG. 1.

The sprinkler illustrated in FIG. 1 comprises a housing, generally designated 2, including a sprinkler head 4 rotatably mounted by a bearing 6 to a stationary vertical upright 8 adapted to be coupled to a pressurized water supply line (not shown). The stationary vertical upright 8 carries a ring gear 10 meshing with a bevel gear 12 carried by the sprinkler head 4 and rotated by a gear transmission as will be described more particularly below, for rotating the sprinkler head about the vertical axis 13 of the sprinkler.

Sprinkler head 4 is formed with a nozzle 14 disposed at an incline to the vertical axis 13 of the sprinkler, and through which the water inletted from the water supply line through stationary upright 8 exits in the form of a jet. The front end 16 of nozzle 14 is of conical shape and terminates in a throat 18 constituting the smallest diameter portion of the nozzle, and thereby determining the rate of discharge of the water through the nozzle.

A rod-shaped plunger 20 having a conical tip is disposed within nozzle 14 and is movable from the extended position illustrated in full lines in FIG. 1, wherein the conical tip projects forwardly through the nozzle throat 18, to a retracted position (indicated by broken lines 20' in FIG. 1) at the opposite end of the conical portion 16 of the nozzle. It will thus be seen that when the plunger 20 is in the illustrated extended position, it effectively restricts the nozzle diameter; and when the plunger is in the broken-line retracted position, it effectively enlarges the nozzle diameter.

Sprinkler head 4 carries a drive, driven by the energy of the water in the pressurized-water supply line, for cyclically reciprocating plunger 20 to its extended and retracted positions, and thereby for cyclically restricting and enlarging the diameter of the nozzle. The foregoing drive includes an impeller 22 disposed with a housing 24 carried by the sprinkler head 4 and rotatably mounted thereon by a shaft 26. For rotating impeller 22, a tube 28 is connected between a port 30 in the sprinkler head 4, and another port 32 leading into the interior of impeller housing 24. Tube 28 thus conducts pressurized water from the sprinkler inlet into the interior of impeller housing 24 for driving the impeller 22. Housing 24 also carries a short-range nozzle 34 for conducting the water thereafter to the atmosphere (see FIG. 1*b*). It will thus be seen that some of the kinetic energy of the portion of the inletted water tapped by tube 28, and conducted to the interior of the impeller housing 24, is used to rotate the impeller 22 before this portion of the water exits through the short-range nozzle 34.

Shaft 26 rotated by impeller 22 passes into the interior of a gear housing 36, also carried by the sprinkler head 4, and drives a pinion 38 within the latter housing. Pinion 38 in turn drives a gear transmission 40 including a plurality of gears, the end gear 42 of which carries a crank arm 44 pivotably connected to one end of a connecting rod 46, the opposite end of which rod is pivotably coupled at 48 to the inner end of plunger 20. It will thus be seen that the rotation of impeller 22 by the kinetic energy of water passing, through impeller housing 24, to the short-range nozzle 34, cyclically reciprocates plunger 20 at a rate corresponding to the transmission ratio of the gear transmission 40 between pinion 38 and crank arm 44.

Pinion 38 driven by impeller 22 also drives a second gear transmission 50 which latter transmission terminates in a spur gear 52. The latter gear meshes with spur gear 12 which, as indicated earlier, meshes with ring gear 10 to rotate the sprinkler head 4 about the sprinkler vertical axis 13 of the stationary upright 8. Gear transmission 50 has a step-down transmission ratio effective to rotate the sprinkler head 4 at a much slower rate than the rate of the cyclical reciprocations of plunger 10 effected by gear transmission 40. For example, plunger 20 may be reciprocated approximately 20–40 cycles per minute, whereas sprinkler head 4 may be rotated a complete cycle every 6–10 minutes; that is, for each complete rotation of the sprinkler head, plunger 20 would reciprocate from 120 to 400 complete cycles.

For purposes of guiding plunger 20 during its reciprocations, its inner end is received within an aperture of a wall 54 of the sprinkler head 4, and an intermediate portion of the plunger is received within a guiding member 56 secured within the sprinkler head. As shown in FIG. 1*a*, guiding member 56 is constituted of two coaxial rings, namely an outer ring 58 secured within nozzle 14, and an inner ring 60 secured to ring 58 by a plurality of radially-extending ribs 62. Plunger 20 is received within the inner ring 60 and is guided thereby during its reciprocations. The radial ribs 62 not only act to support the inner ring 60 for guiding plunger 20, but also act to produce a laminar, nonturbulent flow of the water as it flows into the conical portion 16 of nozzle 14.

The sprinkler illustrated in FIG. 1 operates as follows:

The main portion of the water inletted into the sprinkler housing 2 via its stationary upright 8 issues in the form of a jet through throat 18 of the main nozzle 14. However, a portion of the pressurized water inletted into the sprinkler housing 2 passes through tube 28 to rotate impeller 22 and is outletted through the short-range nozzle 34.

Rotation of impeller 22 cyclically reciprocates plunger 20 from the illustrated extended position of the impeller, wherein its forward tip passes through nozzle throat 18, to the retracted position (illustrated by the broken lines 20') at the opposite end of the conical section 16 of the nozzle. The retracted position of plunger 20 (shown by broken lines 20' in FIG. 1) constitutes the first limit position of the plunger, in which the nozzle is open with an enlarged area to thereby increase the range and rate of water flow therethrough; whereas the retracted position of the plunger constitutes its second limit position, in which the nozzle is still open but its area is restricted to thereby decrease the range and rate of water flow therethrough. The restricted area of the nozzle should be at least 20% of its enlarged area in order to avoid the possibility of "water hammer" effects which have been found to occur when the flow is completely terminated in the restricted position of the plunger. Impeller 22 also acts, via gear transmission 50, spur gears 52 and 12, and ring gear 10, to rotate sprinkler head 4 about the sprinkler axis 13, so that during the reciprocation of plunger 20 the sprinkler head 14 is also rotated to thereby distribute the water 360° around the sprinkler.

Figures 2, 2A, 2B, 2C:
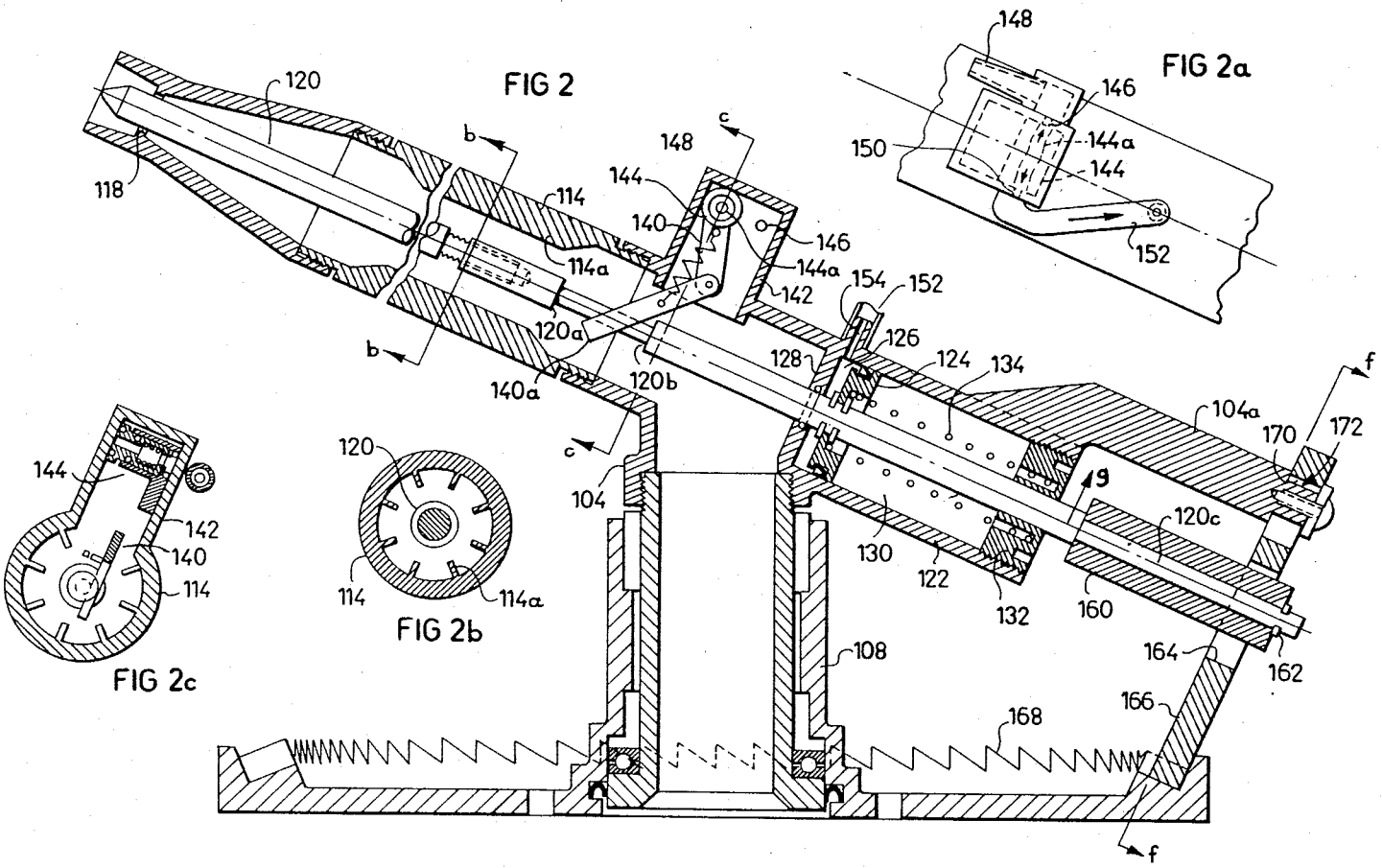
FIG. 2 is a longitudinal sectional view illustrating a second rotary sprinkler constructed in accordance with the invention, FIG. 2*a* being a top view of a frangment of the sprinkler of FIG. 2, FIG. 2*b* and 2*c* being sectional views along lines b—b and c—c of FIG. 2, FIG. 2*d* being an enlarged fragmentary view of FIG. 2, FIG. 2*e* being a sectional view along lines e—e of FIG. 2*d*, FIG. 2*f* being an enlarged fragmentary view along lines f—f of FIG. 2, FIG. 2*g* being a sectional view along lines g—g of FIG. 2, and FIG. 2*h* being an end view of FIG. 2*g*.

FIG. 2 illustrates a construction similar to that of FIG. 1, except that it includes a different form of drive for reciprocating the plunger (therein designated 120) with respect to the nozzle throat 118, and also for rotating the sprinkler head 104 about the vertical axis of the sprinkler. Its conical nozzle 114 also of slightly different construction, being formed w with inner, radially-extending vanes 114*a* for producing the laminar nonturbulent flow through the nozzle.

For reciprocating plunger 120, the rear end of nozzle 114 is extended so as to define a cylinder 122 in which is movable a piston 124 secured to the rear end of the plunger. Piston 124 thus defines a first chamber 126 on one side of the piston enclosed by nozzle end wall 128, and a second chamber 130 on the opposite side of the piston closed by a plug 132. Chamber 126 is a drive chamber and drives plunger 120 to its retracted position; whereas chamber 130 receives a return spring 134 which is loaded during the retraction stroke and is effective to drive the piston, and thereby the plunger 120, to its extended position. As in the above-described FIG. 1 embodiment, the energy of the pressurized water inletted into the sprinkler is also used, in this FIG. 2 embodiment, for cyclically reciprocating plunger 120, and also for rotating the sprinkler about its vertical axis. In the FIG. 2 arrangement, however, the pressurized water acts directly to reciprocate the plunger 120, and the reciprocations of the plunger act directly to rotate the sprinkler head about its axis.

Figures 2D, 2E, 2F, 2G, 2H:
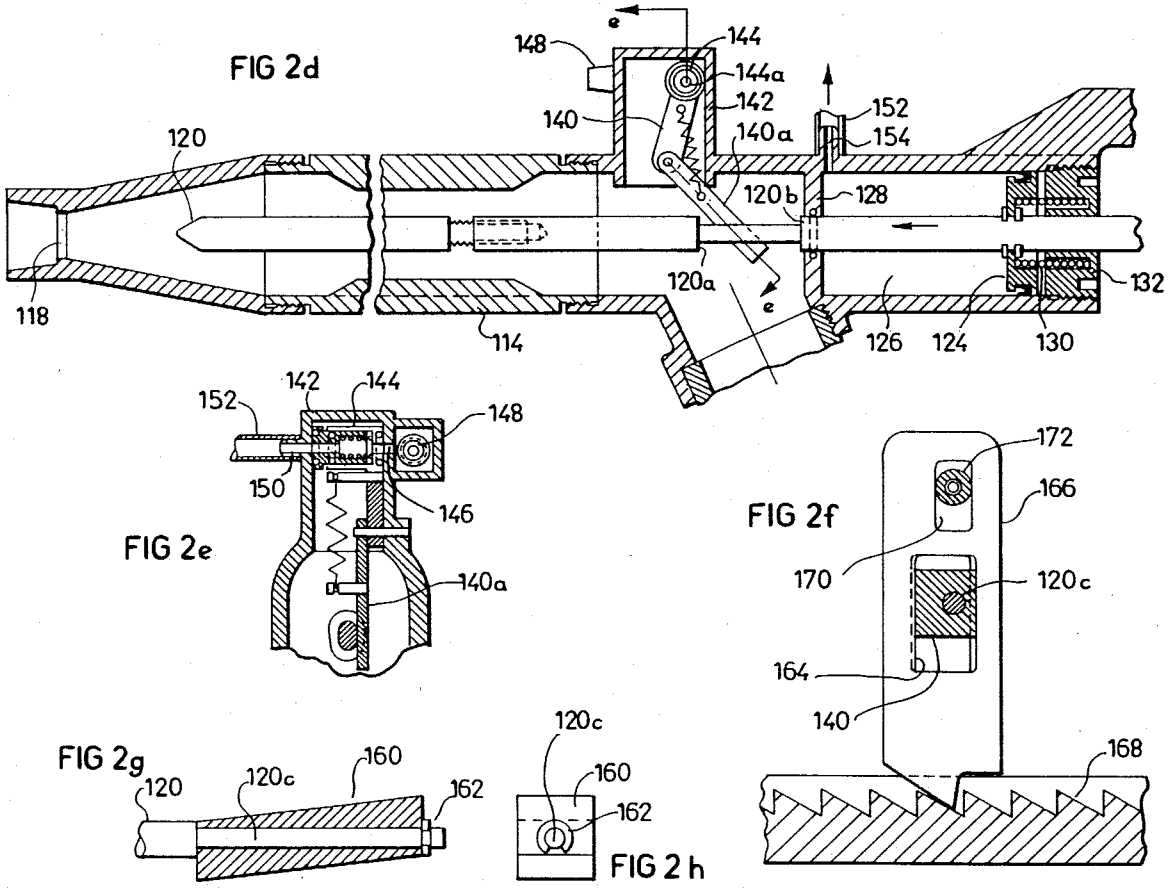

Thus, sprinkler head 104 carries a toggle assembly 140 disposed within a housing 142, and actuatable by shoulders 120*a*, 120*b* of the plunger 120, either to a first position as illustrated in FIG. 2, wherein the toggle member 144 is displaced away from a port 146 in the toggle housing 142, or to a second position as illustrated in FIG. 2*d*, wherein this toggle member is aligned with port 146. As shown particularly in the top plan view of FIG. 2*a*, port 146 communicates with a short-range nozzle 148 (corresponding to 34 in FIG. 1), carried at one side of the toggle housing 142. The opposite side of toggle housing 142 is formed with another port 150, aligned with port 146, port 150 being connected by a tube 152 to a port 154 leading into chamber 126 defined by piston 124 and end wall 128 of cylinder 122.

As shown particularly in FIG. 2, the interior of toggle housing 142 communicates with the inlet of the sprinkler, so that when the toggle member 144 is in the position illustrated in FIG. 2, a portion of the pressurized water inletted into the sprinkler flows through port 146 to the short-range nozzle 148. Another portion of this inletted water flows through port 150 (FIG. 2*a*), tube 152, and port 154, into chamber 126 of the cylinder 122, thereby displacing piston 124 (rightwardly) to expand chamber 126 and to load spring 134. This causes plunger 120 to be retracted with respect to the nozzle throat 118, thereby enlarging the effective diameter of the nozzle throat. At the end of the retraction stroke of the plunger, its shoulder 128 engages the end of toggle link 140*a* thereby actuating the toggle assembly 140 to move toggle member 144 to the position illustrated in FIG. 2*d*, wherein member 144 is aligned with the two ports 146 and 150 (FIG. 2*a*).

Toggle member 144 is formed with a bore 144*a* extending therethrough, as shown particularly in FIGS. 2 and 2*e*, so that in this actuated position of the toggle member, it interrupts the connection of the sprinkler inlet to the short-range nozzle 148 and to chamber 126, but rather connects chamber 126 directly to the short-range nozzle 148 via tube 152 and bore 144*a* of the toggle member 144. This portion of the toggle member 144 permits the return spring 134 to return piston 124 in cylinder 122, the water within chamber 126 being thereby vented to the atmosphere via the short-range nozzle 148. Spring 134 thus drives plunger 120 through the retraction stroke of the plunger wherein it restricts the diameter of the nozzle throat 118.

As indicated earlier, the reciprocations of plunger 120 are used for also rotating the sprinkler head 104 about the vertical axis of the sprinkler. For this purpose, the sprinkler is provided with a linear-to-rotary converter mechanism which converts the linear reciprocations of plunger 120 to a rotary movement of the sprinkler head 104 about its vertical axis.

In the FIG. 2 embodiment, this linear-to-rotary converter comprises a bar 160 (see particularly FIGS. 2*f* and 2*g*) of rectangular section and formed with an eccentric bore rotatably receiving a reduced-diameter extension 120*c* of plunger 120, bar 160 being removably retained on plunger extension 120*c* by a retainer clip 162. Bar 160, which serves as a cam member during the reciprocatory movements of plunger 120, is movable within a rectangular slot 164 formed in a pawl 166 cooperable with a toothed ring 168 carried by the sprinkler stationary upright 108 and circumscribing its longitudinal axis. The upper end of pawl 166 is formed with another rectangular slot 170 receiving a pin 172 fixed to an extension 104*a* of the sprinkler head 104, and thereby permitting only displacements of the pawl in the vertical direction.

The operation of the FIG. 2 embodiment will be apparent from the above description. Thus, assuming that plunger 120 is in its extended position as illustrated in FIG. 2, wherein its toggle member 144 is out of alignment with ports 146 and 150 in the toggle housing 142, most of the pressurized water from the sprinkler inlet issues as a jet from the main nozzle 116, but since its throat 118 is restricted by plunger 120, the range of the jet and the quantity of water therein, are both restricted. A portion of the inletted pressurized water also issues from the short-range nozzle 148 via port 146. Another portion of the inletted pressurized water flows via port 150 and tube 152 into chamber 126, thereby expanding that chamber by displacing piston 124 rightwardly against spring 134.

This displacement of piston 124 drives plunger 120 through its retraction stroke, wherein it moves out of and away from nozzle throat 118, thereby enlarging the nozzle diameter to increase the range and also the quantity of water in the jet issuing from the main nozzle 118.

This retraction stroke of plunger 120 is terminated as soon as shoulder 120*a* of the plunger engages link 140*a* of the toggle assembly 140, wherein the toggle assembly is actuated to move toggle member 144 to its actuated position as illustrated in FIG. 2*d*. In this position, toggle member 144 covers both of the ports 150 and 146, thereby terminating the connection of the sprinkler inlet to the short-range nozzle 148, and also to chamber 126. However, bore 144*a* through toggle member 144 establishes communication between chamber 126 and the short-range nozzle 148, thereby permitting spring 134 to return piston 124 (leftwardly) while the water within chamber 126 is vented to the atmosphere via tube 152 and the short-range nozzle 148.

It will thus be seen that during this extension stroke of the plunger 120, it moves towards nozzle throat 118, decreasing its effective diameter to thereby decrease the range of the jet issuing from the main nozzle 118, and the quantity of water within that jet. This extension stroke of plunger 120 continues until shoulder 120*b* of the plunger engages link 140*a* of the toggle mechanism 140, whereupon the toggle mechanism is actuated to the position illustrated in FIG. 2, to start the next retraction stroke of the plunger.

These reciprocations of the plunger cause its cam bar 160, moving within slot 164 of pawl 166, to reciprocate the pawl into engagement and disengagement with the teeth of ring 168 circumscribing the vertical axis of the sprinkler, thereby rotating the sprinkler about its vertical axis one step for each complete reciprocatory cycle of the plunger.

Figure 3:
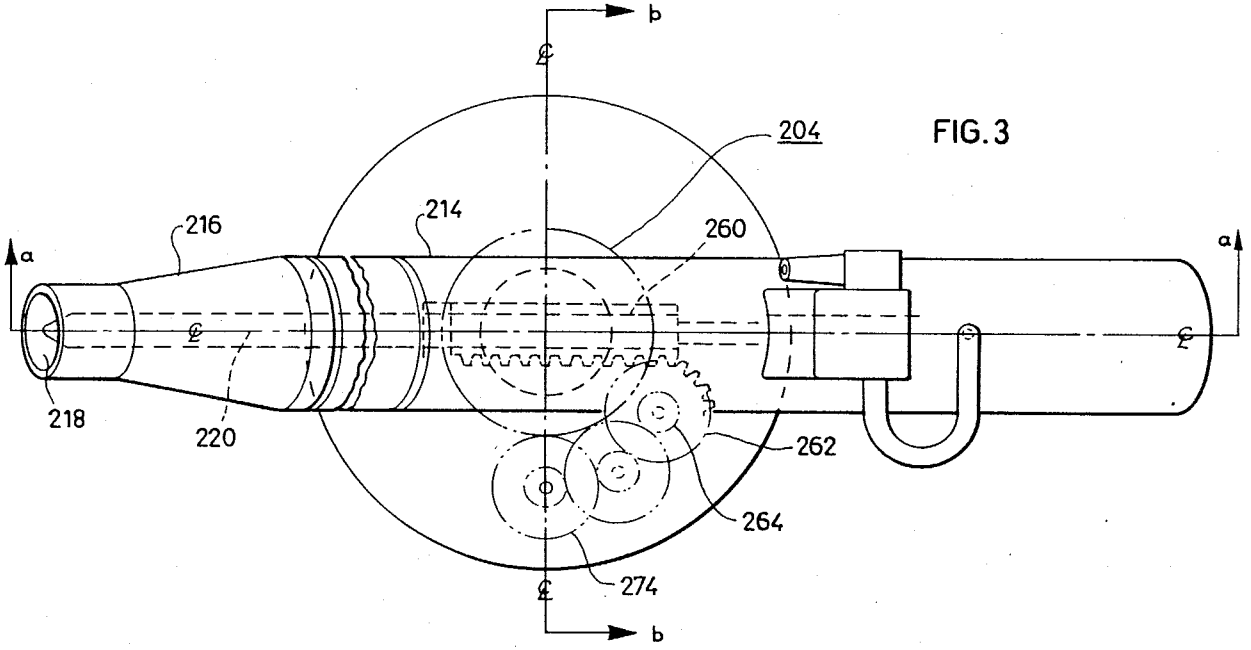
FIG. 3 is a top plane view of a third form of rotary sprinkler constructed in accordance with the present invention, FIGS. 3*a* and 3*b* being sectional views along lines a—a and b—b, respectively, of FIG. 3.

FIG. 3 illustrates another sprinkler, similar to that of FIG. 2, but with a different linear-to-rotary converter mechanism for converting the reciprocations of the plunger to rotation of the sprinkler head about the sprinkler vertical axis.

Figure 3A:
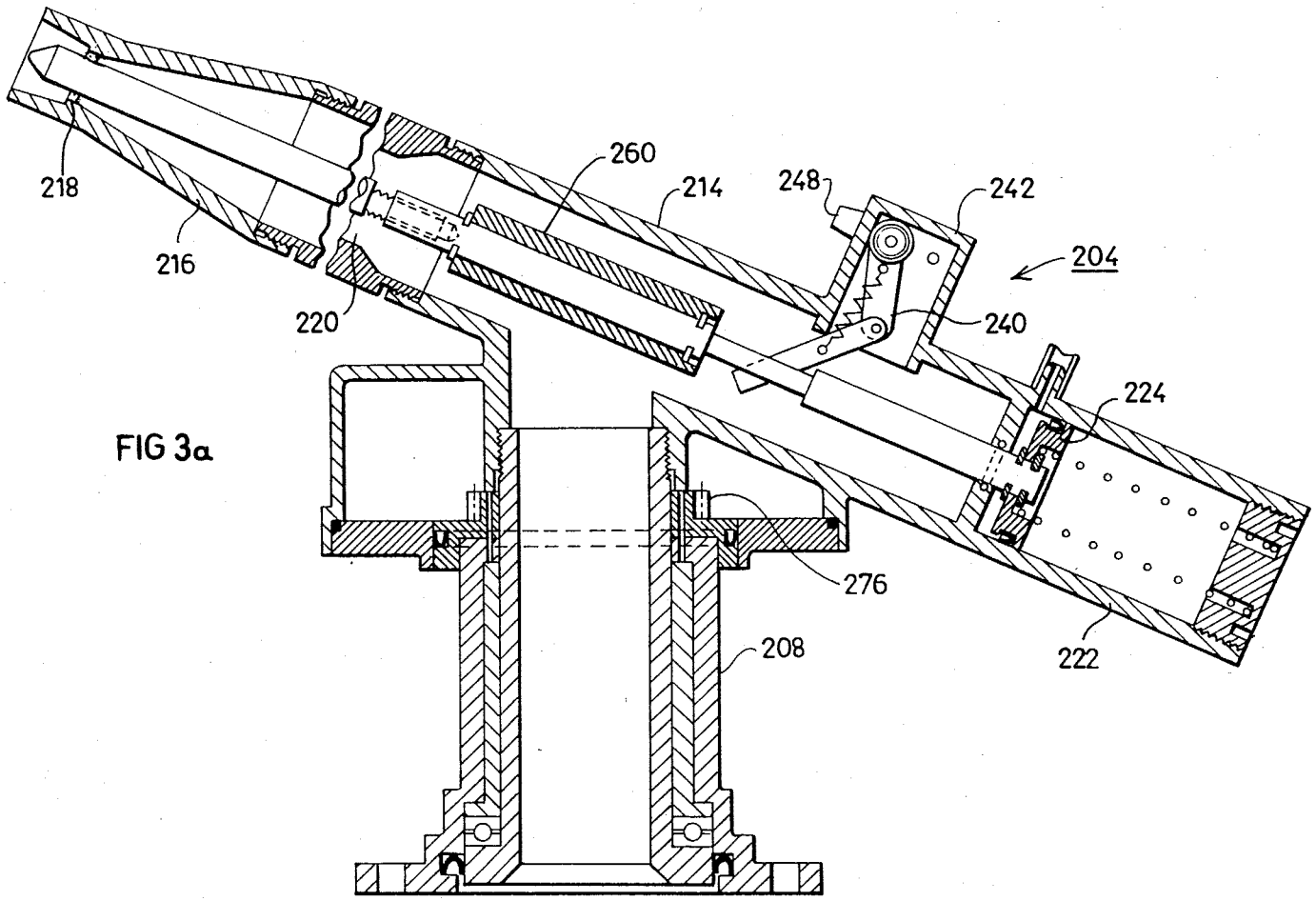

Thus, the sprinkler in FIG. 3 also includes a sprinkler head, therein designated 204, rotatably mounted about the sprinkler vertical axis, which sprinkler head includes an inclined nozzle 214 having a conical portion 216 terminating in the nozzle throat 218, and a plunger 220 cyclically reciprocated within the sprinkler nozzle to restrict and enlarge the effective diameter of the nozzle throat 218, as shown particularly in FIG. 3*a*. Plunger 220 in this embodiment is also reciprocated by a piston 224 displaceable within a cylinder 222 by the energy of the pressurized water inletted into the sprinkler, which reciprocations are controlled by a toggle assembly 240 within a toggle housing 242, which toggle housing also includes a short-range nozzle 248, all as described above with respect to the FIG. 2 embodiment.

However, the linear-to-rotary converter mechanism in the FIG. 3 embodiment, which converts the reciprocatory movements of plunger 220 to rotary movement of the sprinkler head 214 about the vertical upright 208, comprises an inclined gear rack 260 secured to plunger 220 and meshing with a pinion 262 rotatably mounted about a vertical shaft 264. The lower face of pinion 262 is formed with ratchet teeth co-operable with a ratchet 266 fixed to shaft 264 and urged against the ratchet teeth of pinion 262 by a spring 268. A second pinion 270 is fixed to the opposite end of shaft 264, the latter pinion driving a step-down gear transmission 272 which terminates in a gear 274 meshing with a ring gear 276 secured to the stationary upright 208 of the sprinkler. The ratchet 266 thus forms a one-way coupling between rack 260 and the step-down gear transmission 272, such that the latter rotate the sprinkler head only with respect to one reciprocatory stroke of the plunger 220.

It will thus be seen that plunger 220 is reciprocated by the pressurized water of the supply line in the same manner as described above with respect to the FIG. 2 embodiment, and that these reciprocations are converted to rotary movements of the sprinkler head 204 by rack 260 which is reciprocated with the plunger, and the one-way coupling including ratchet 266 coupling the movement of the rack to the gear transmission 272, 274, the latter engaging the ring gear 276 fixed to the stationary upright 208.

Figure 4:
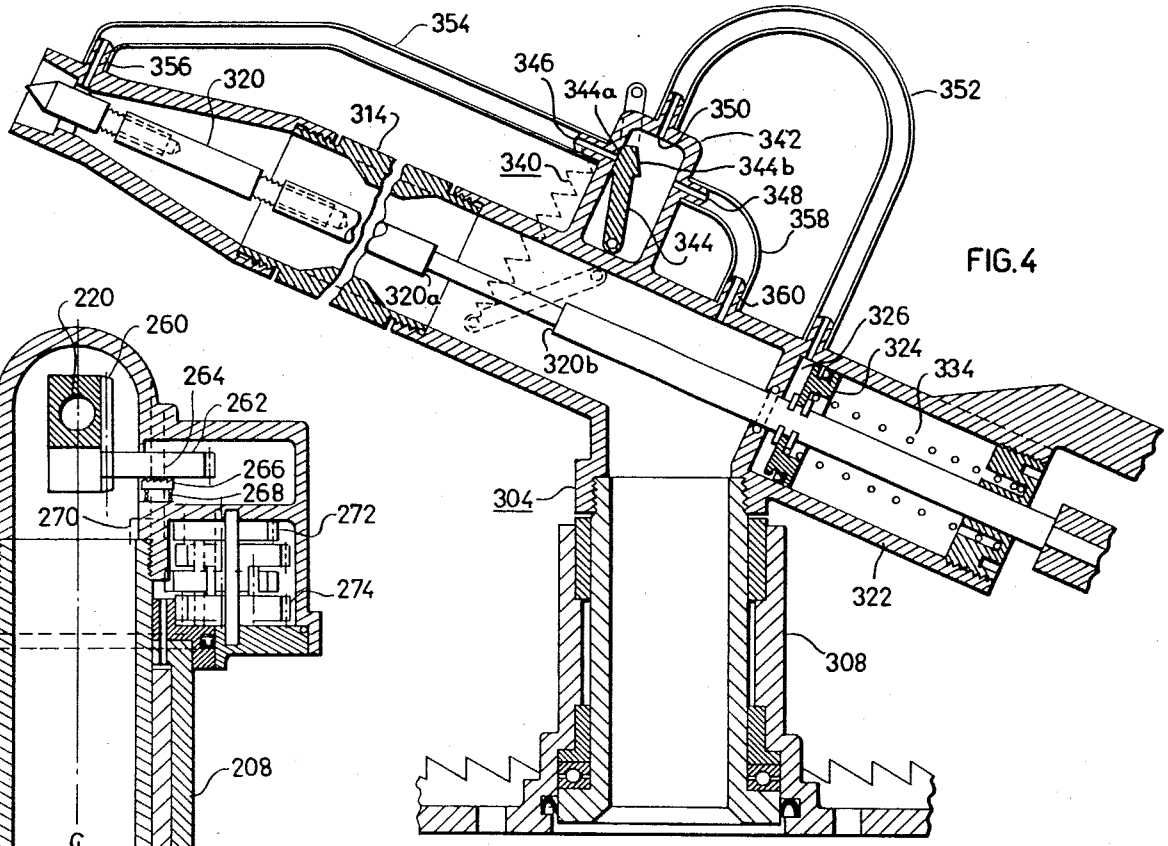
FIG. 4 is a longitudinal sectional view illustrating a fourth form of rotary sprinkler constructed in accordance with the present invention.
Figure 3B:
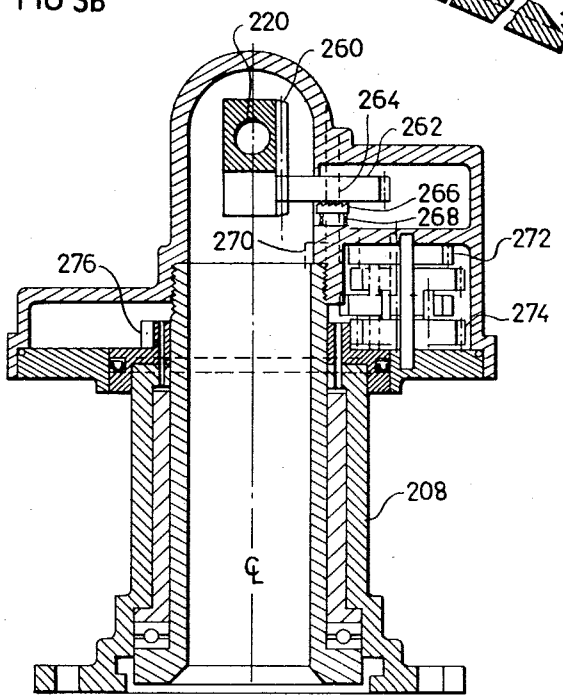

FIG. 4 illustrates a still further embodiment of the invention, involving the elimination of the short-range nozzle, and also a modification in the manner of reciprocating the plunger 320 by the energy of the pressurized water inletted into the sprinkler. The arrangement for rotating the sprinkler head, therein designated 304, about the vertical upright 308, may be as in the FIG. 2 or FIG. 3 embodiments, and therefore is not illustrated in FIG. 4.

In the embodiment of FIG. 4, the plunger 320 is reciprocated within the nozzle 314 by a similar arrangement as illustrated in FIGS. 2 and 3, namely by piston 324 driven within cylinder 322, by inletting pressurized water into chamber 326, the return stroke being effected by return spring 334. The FIG. 4 embodiment also includes a toggle assembly, generally designated 340, disposed within a toggle housing 342, and actuated by shoulders 320*a* and 320*b* of the plunger 320. In this case, however, the toggle member 344 is of a different configuration in that it includes two faces 344*a*, 344*b*, adapted in one position of the toggle member (namely, the position illustrated in FIG. 4) to close port 346 in toggle housing 342, and in the other position of the toggle member, to close port 348. Toggle housing 342 includes a further port 350 connected by tube 352 to chamber 326. Port 348 is connected by a further tube 354 to port 356 in the nozzle head 314 so as to receive pressurized water from the sprinkler inlet; and port 346 is connected by tube 358 to a further port 360 communicating with the nozzle throat 318 (or with any other low-pressure point in the nozzle).

It will thus be seen that in FIG. 4 illustrated position of toggle member 344, communication is established from the sprinkler inlet to chamber 326 via ports 356, 348, and 350, and via tubes 354 and 352, such that the pressurized water expands chamber 326 and moves piston 324 rightwardly to drive plunger 320 through its retraction stroke. At the end of that stroke, shoulder 320*a* of the plunger actuates the toggle member 344 to close port 348 and to establish communication between ports 350 and 346, whereupon chamber 326 is vented to the atmosphere via tubes 352 and 358, and nozzle throat 318. Accordingly, return spring 334 is now able to drive piston 324 leftwardly, thereby driving plunger 320 through its extension stroke, which stroke is terminated by the engagement of shoulder 320*b* with the toggle mechanism 340.

In all the above-described embodiments, the restricted flow through the main nozzle (i.e. when the plunger is in its most extended position as illustrated in FIG. 1, for example) should not be less than 20% of the full flow rate. As noted above, this avoids the possibility of "water hammer" effects which could result if the flow is completely terminated.

The illustrated novel sprinklers can be designed so as to provide an increase in the area coverage of between 20–50% over conventional sprinklers of this type because of the greater range provided by cyclically driving the plunger to restrict and enlarge its nozzle throat. In addition, the novel sprinkler can provide a lower application rate than conventional commercial sprinklers, e.g. application rates of 4 to 6 mm per hour. Further, since the plunger moves continuously, continuous changes in nozzle discharge pressure and the geometrical configuration of the jet stream cross-section, provides a more uniform distribution of the water. Also, because of the increased range and area coverage provided by the novel sprinklers, a given installation requires fewer more widely spaced sprinklers, thereby saving not only in the cost of the sprinklers, but also in piping, energy, and service-road costs.

It will be appreciated that while the invention has been described with respect to several preferred embodiments, these are set forth for purposes of example only, and that many other variations, modifications, and applications of the invention may be made.

What is claimed is:

1. A water sprinkler, comprising: a housing having an inlet connectable to a pressurized water supply line, and a nozzle through which the water issues in the form of a jet; a control member cyclically movable between a first limit position wherein the nozzle is open with an enlarged area to thereby increase the range and rate of water flow therethrough, and a second limit position wherein the nozzle is still open but its area is restricted to thereby decrease the range and rate of water flow therethrough; and a drive driven by the energy of the water in the pressurized water supply line for cyclically driving said control member to enlarge and restrict the nozzle.

2. The sprinkler according to claim 1, wherein said nozzle includes a throat, and said control member is in the form of a plunger cyclically reciprocated by said drive to enlarge and restrict said nozzle throat.

3. The sprinkler according to claim 2, wherein said nozzle is carried by a sprinkler head rotatably mounted to said housing, said drive also cyclically displacing said sprinkler head about the vertical axis of the sprinkler.

4. The sprinkler according to claim 3, wherein the cycles of displacement of the sprinkler head are many times longer than the cycles of reciprocation of the plunger.

5. A water sprinkler, comprising: a housing having an inlet connectable to pressurized water supply line, a sprinkler head, and a nozzle having a throat for issuing the water in the form of a jet; a plunger cyclically reciprocated between a first limit position within the nozzle wherein the nozzle throat is open with an enlarged area to thereby increase the range and rate of water flow therethrough, and a second limit position within the nozzle wherein the nozzle throat is still open but its area is restricted to thereby decrease the range and rate of the water flow therethrough; the restricted area of the nozzle throat being at least 20% of the enlarged area of the nozzle throat; and a drive driven by the energy of the water in the pressurized water supply line for cyclically driving said plunger to enlarge and restrict the nozzle throat.

6. The sprinkler according to claim 5, wherein said sprinkler head is rotatably mounted to said housing, said drive also cyclically displacing said sprinkler head about the vertical axis of the sprinkler.

7. The sprinkler according to claim 6, wherein said nozzle includes a ring coaxially therewith and supported thereby by a plurality of radially-extending ribs, said plunger passing through said ring and being guided thereby during the reciprocation of the plunger.

8. The sprinkler according to claim 6, wherein said drive includes an impeller driven by water inletted from the pressurized water supply line, said impeller being coupled by a first transmission to said plunger for cyclically reciprocating same, and by a second transmission to said sprinkler head for displacing same about the sprinkler vertical axis.

9. The sprinkler according to claim 8, wherein said sprinkler head further includes a short-range nozzle, the water driving the impeller being outletted through said latter nozzle.

10. The sprinkler according to claim 8, wherein said first and second transmissions are both gear transmissions, the second gear transmission having a much higher step-down gear ration than the first gear transmission such that the cycles of displacement of the sprinkler head about the sprinkler verticle axis are much longer than the cycles of reciprocation of the plunger.

11. The sprinkler according to claim 6, wherein said drive includes a piston movable within a cylinder and defining a drive chamber therewith for reciprocating the plunger, the sprinkler further including a switching mechanism actuatable at the end of each reciprocatory stroke of the plunger for actuating the drive to reciprocate the plunger in the opposite direction.

12. The sprinkler according to claim 11, wherein said drive chamber is on one side of said piston and is adapted to receive pressurized water from the supply line to drive the plunger through one reciprocatory stroke, said cylinder including a return spring acting on the opposite side of said piston for driving the plunger through the other reciprocatory stroke.

13. The sprinkler according claim 11, wherein said switching mechanism includes a toggle member actuated by the plunger at the end of each reciprocatory stroke.

14. The sprinkler according to claim 13, wherein the plunger is coupled via a linear-to-rotary converter to the sprinkler head, to angularly displace same by the reciprocations of the plunger.

15. The sprinkler according to claim 14, wherein said linear-to-rotary converter comprises a cam carried by said plunger, and a pawl co-operable with a toothed wheel carried by the sprinkler housing such that, with each reciprocatory stroke of the plunger, the cam actuates the pawl to step the sprinkler head around the sprinkler housing.

16. The sprinkler according to claim 14, wherein said linear-to-rotary converter comprises a gear rack carried by said plunger and co-operable, via a one-way clutch, with a pinion to rotate the sprinkler head by the reciprocations of the plunger.

17. The sprinkler according to claim 13, wherein said toggle mechanism is movable within a toggle housing having a first port communicating with the sprinkler housing inlet, a second part communicating with the drive chamber defined by said piston and cylinder, and a third port leading to the atmosphere; said toggle mechanism including a toggle member movable to connect said first port to said second port to effect one reciprocatory stroke of the plunger, and to connect said second port to said thirt port to effect the other reciprocatory stroke of the plunger.

18. The sprinkler according to claim 17, wherein said third port leads to the outlet end of said nozzle.

19. The sprinkler according to claim 5, wherein said plunger includes two parts adjustable with respect to each other to vary the length of the plunger with respect to said nozzle, and thereby the discharge rate from said nozzle.

* * * * *